US009651331B2

(12) United States Patent
Kim

(10) Patent No.: US 9,651,331 B2
(45) Date of Patent: May 16, 2017

(54) TOY BOW AND TOY CROSSBOW USING THE SAME

(71) Applicant: Yong Chul Kim, Seoul (KR)

(72) Inventor: Yong Chul Kim, Seoul (KR)

( * ) Notice: Subject to any disclaimer, the term of this patent is extended or adjusted under 35 U.S.C. 154(b) by 48 days.

(21) Appl. No.: 14/960,296

(22) Filed: Dec. 4, 2015

(65) Prior Publication Data

US 2016/0169612 A1 Jun. 16, 2016

(30) Foreign Application Priority Data

Dec. 15, 2014 (KR) ..... 10-2014-0178502

(51) Int. Cl.
*F41B 5/00* (2006.01)
*F41B 5/12* (2006.01)

(52) U.S. Cl.
CPC ..... *F41B 5/12* (2013.01); *F41B 5/0094* (2013.01)

(58) Field of Classification Search
CPC ..... F41B 5/12; F41B 5/123; F41B 5/1403; F41B 5/10; F41B 5/0094; F41B 5/0052
See application file for complete search history.

(56) References Cited

U.S. PATENT DOCUMENTS 1,161,642 A * 11/1915 Enos ..... F41B 5/0073 124/23.1
4,178,905 A * 12/1979 Groner ..... F41B 5/10 116/294
4,388,914 A * 6/1983 Cesin ..... F41B 5/12 124/25
4,651,707 A * 3/1987 Bozek ..... F41B 5/0094 124/17
5,165,382 A * 11/1992 Morrison ..... F41B 5/10 124/23.1
5,353,777 A * 10/1994 Fincher ..... F41B 5/10 124/16
6,634,347 B2 * 10/2003 Holler ..... F41B 5/10 124/23.1
8,851,056 B2 * 10/2014 Trpkovski ..... F41B 5/10 124/23.1
2009/0032002 A1 * 2/2009 Howard ..... F41B 5/10 124/25.6
2012/0006310 A1 * 1/2012 Sims ..... F41B 5/10 124/25
2012/0160224 A1 * 6/2012 Walterscheid ..... F41B 5/0094 124/20.1
2014/0190461 A1 * 7/2014 Sims ..... F41B 5/10 124/25.6
2014/0338647 A1 * 11/2014 Cummings ..... F41B 7/08 124/20.3
2014/0360480 A1 * 12/2014 Koch ..... F41B 5/10 124/25.6

* cited by examiner

*Primary Examiner* — Melba Bumgarner
*Assistant Examiner* — Amir Klayman
(74) *Attorney, Agent, or Firm* — Im IP Law; C. Andrew Im

(57) ABSTRACT

A toy bow configured to adjust an angle of both ends of its limb by an angle adjustor, thereby enabling the user to easily change the size and the angle of the limb, if necessary. The benefit not only extends to using the bow, but also to storing and carrying to bow due to its reduced size. Preferably, the limb is detachably mountable to a stock of a crossbow to conveniently change its application from a toy bow to a toy crossbow and vice-versa.

11 Claims, 6 Drawing Sheets

TOY BOW AND TOY CROSSBOW USING THE SAME

RELATED APPLICATION

This application claims priority from Korean Patent Application 10-2014-0178502 filed Dec. 15, 2014, which is herein incorporated by reference in its entirety.

BACKGROUND OF THE INVENTION

Field of the Invention

The present invention relates to a toy bow, and more specifically, to a toy bow capable of adjusting an angle of both ends of a limb by an angle adjustor, and easily detachably mounting the limb to a stock of a crossbow to conveniently change its application between the bow and the crossbow. Also, the present invention relates to a toy crossbow using the toy bow.

Background of the Related Art

In general, a bow consists of a string attached to both ends of a limb. A crossbow consist of a limb, to which a bowstring is attached, and a stock connected to the limb. That is, the crossbow is designed to be easily used rather than the general bow.

A toy crossbow has the substantially same structure as that of the weapon crossbow, but utilizes safe arrows.

Korea Unexamined Utility Model Publication No. 20-1986-0001912 discloses such a toy crossbow.

The crossbow disclosed in the publication includes a stock, limbs mounted to one end of the stock, and a bowstring attached to ends of the both limbs.

The stock is provided with a trigger for holding the drawn bowstring.

The bowstring is drawn from the limbs, and then is retained by a rolling cylindrical pawl (referred to as a nut) provided on the stock. After an arrow is placed on the stock, an archer pulls the trigger to fire the arrow.

However, the bow or the crossbow of the related art has a problem in that since a size or an angle of the limb cannot be adjusted, it is inconvenient to carry, and a large storage space is required.

Also, the case of the crossbow of the related art is not convenient since the usage of the crossbow cannot be altered.

SUMMARY OF THE INVENTION

Therefore, the present invention has been made in view of the above problems, and an object of the present invention is to provide a toy bow capable of adjusting an angle of both ends of a limb by an angle adjustor and thus easily changing a size and an angle of the limb, if necessary, thereby improving the convenience in use.

The other object of the present invention is to provide a toy bow capable of being easily carried and requiring a small storage space.

Another object of the present invention is to provide a toy bow capable of easily detachably mounting a limb to a stock of a crossbow to conveniently change its application between the bow and the crossbow.

Still another object of the present invention is to provide a toy crossbow using the toy bow described above.

according to one aspect of the present invention, there is provided a toy bow comprising a limb and a bowstring which is attached to both ends of the limb, the limb including a body; and a pair of wings which are engaged to both ends of the body to be able to adjust an angle thereof by an angle adjustor, to which the bowstring is attached.

According to another aspect of the present invention, there is provided a toy crossbow comprising a limb, a bowstring which is attached to both ends of the limb, and a stock which is engaged to the limb, the limb including a body to which the stock is engaged; and a pair of wings which are engaged to both ends of the body o be able to adjust an angle thereof by an angle adjustor, to which the bowstring is attached.

With the above configuration, the toy bow and the toy crossbow can adjust the angle of both ends of the limb by the angle adjustor and thus easily changing the size and the angle of the limb, if necessary, thereby improving the convenience in use. Also, the toy bow and the toy crossbow can be easily carried and require the small storage space. In addition, the limb can easily detachably mounted to the stock of the crossbow to conveniently change its application between the bow and the crossbow.

DETAILED DESCRIPTION OF THE PREFERRED EMBODIMENT

Figure 1:
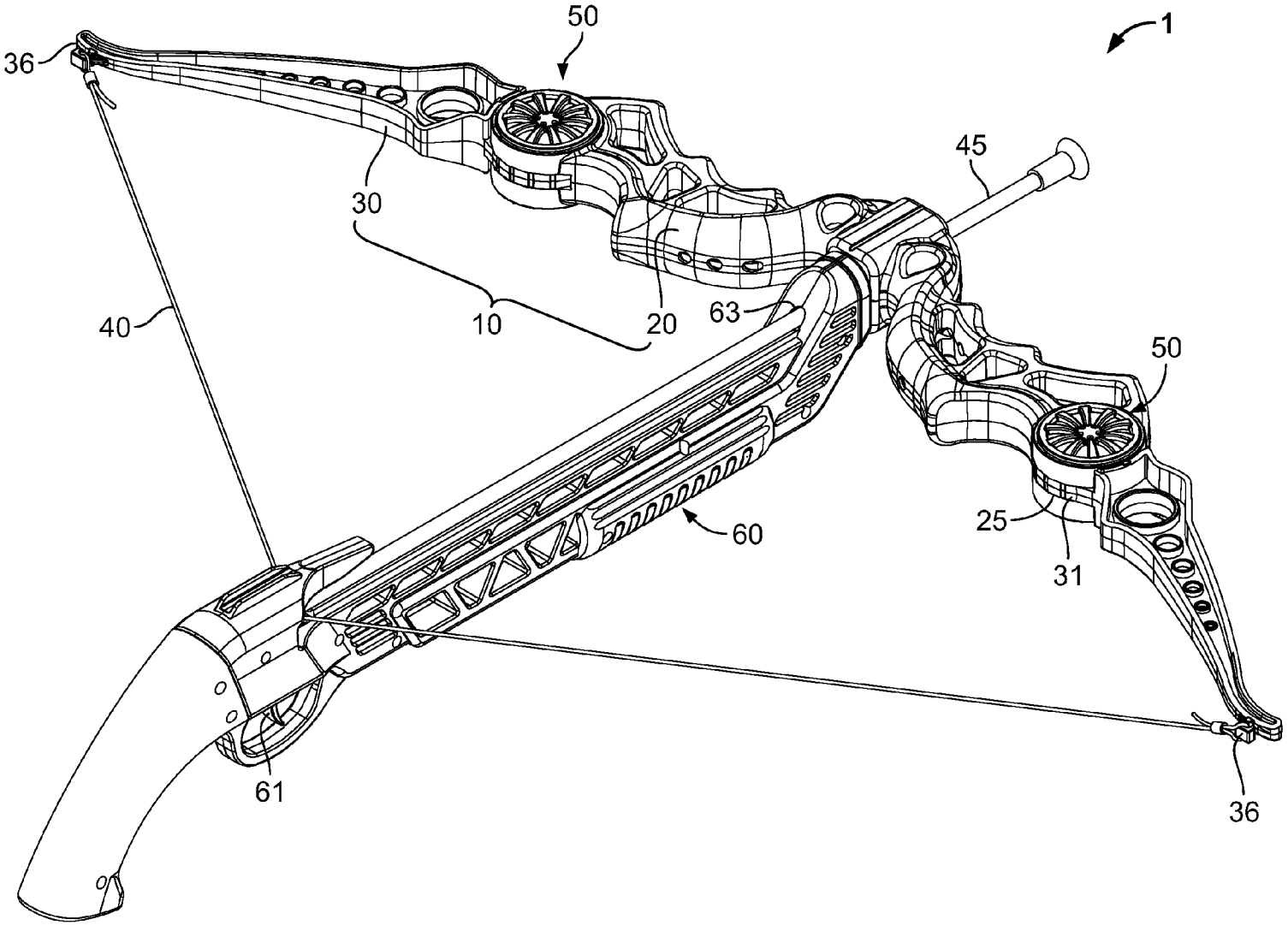
FIG. 1 is a perspective view illustrating a toy crossbow according to the present invention.
Figure 2:
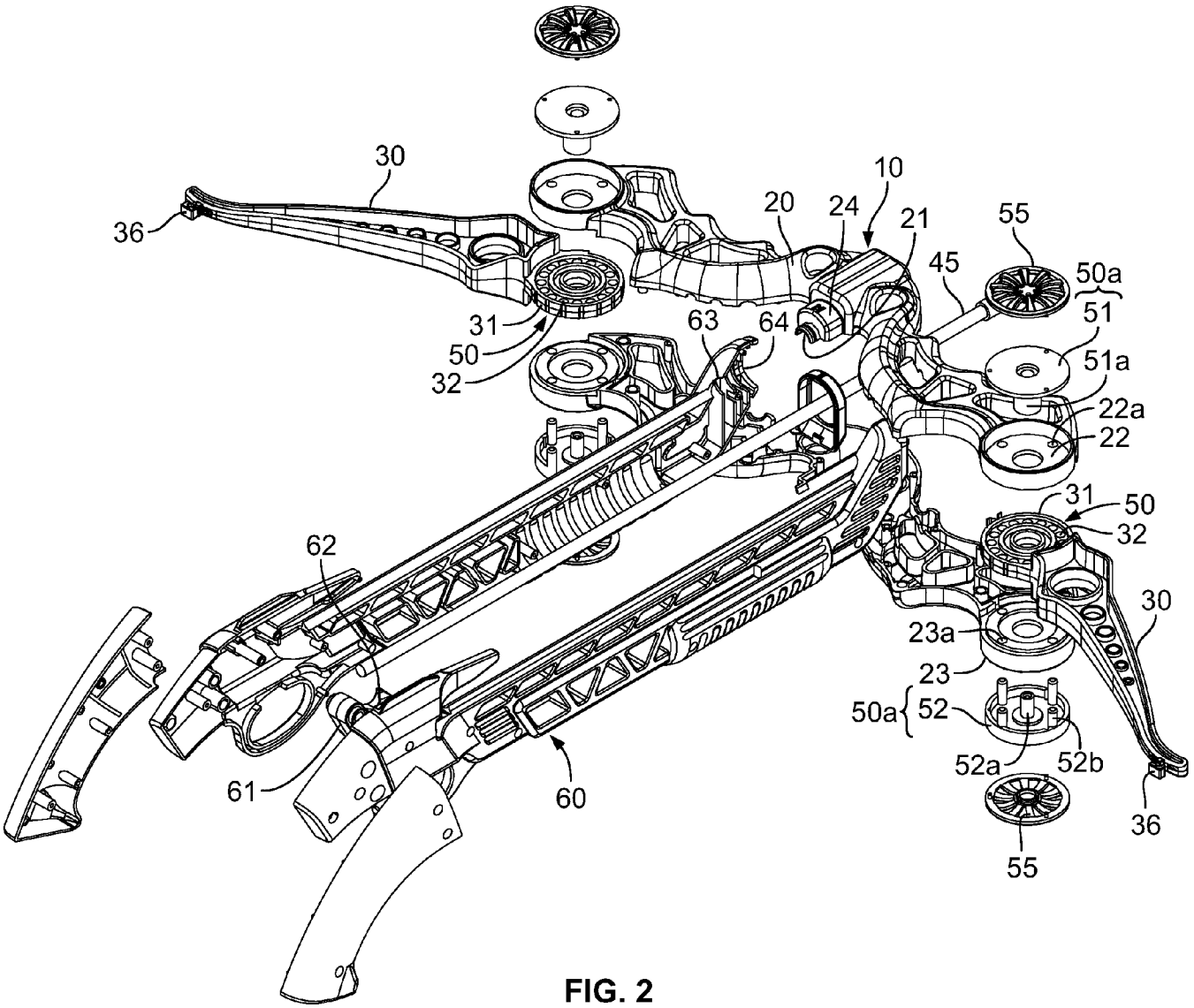
FIG. 2 is an exploded perspective view illustrating the toy crossbow according to the present invention.
Figure 3:
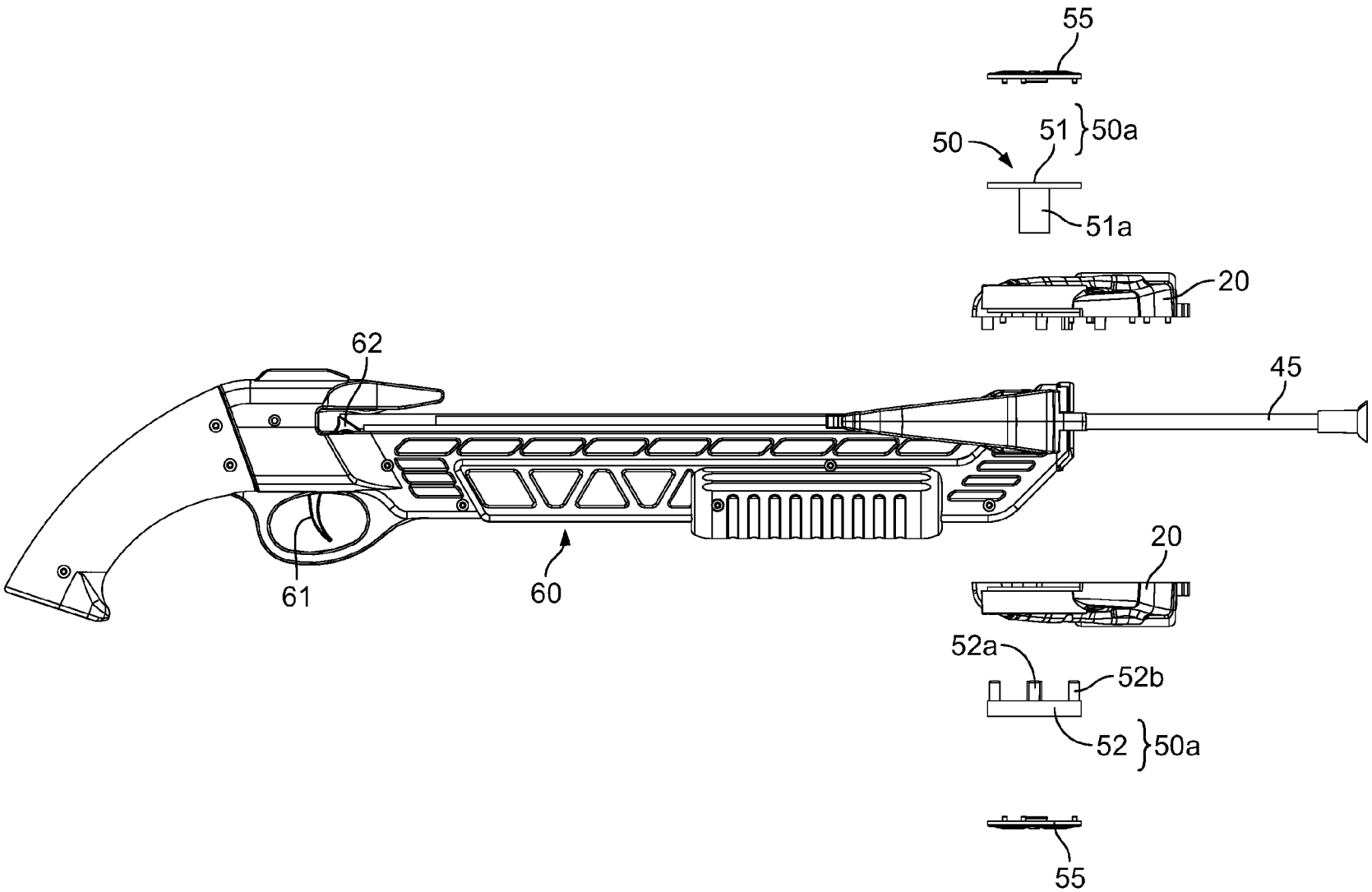
FIG. 3 is a side view of the toy crossbow in FIG. 2.
Figure 4:
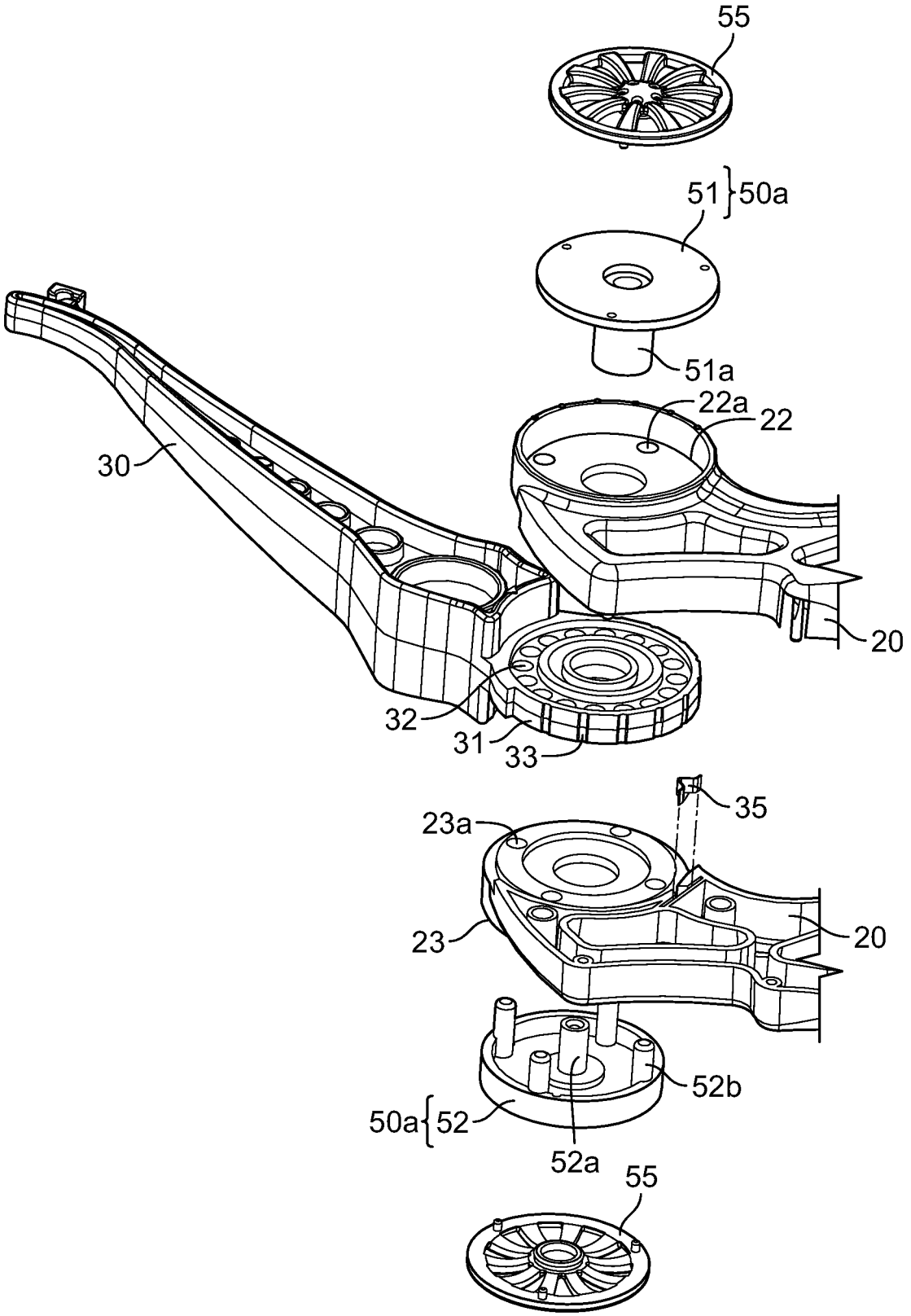
FIG. 4 is an exploded perspective view illustrating an angle adjustor for the toy crossbow according to the present invention.
Figure 5:
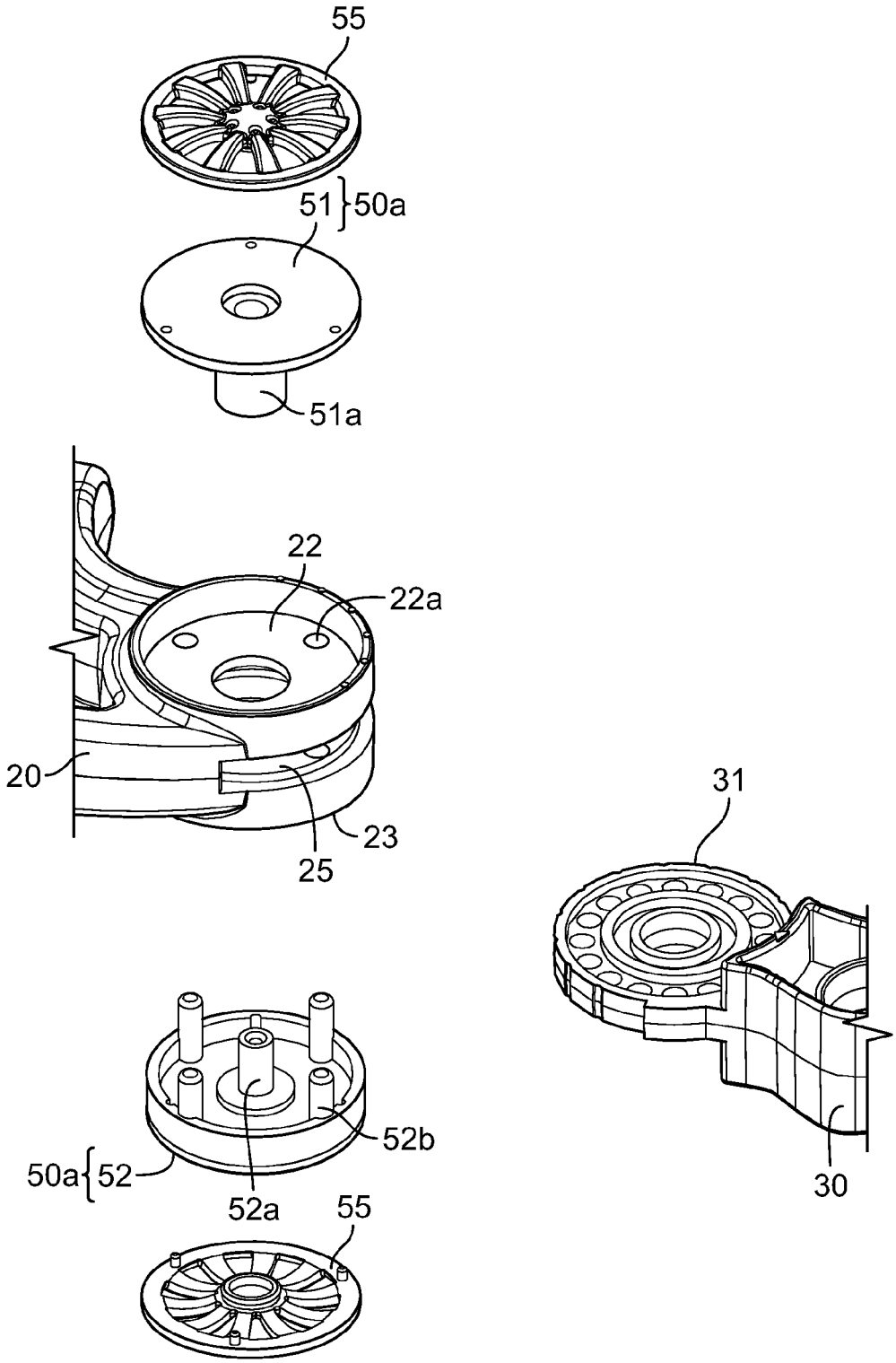
FIG. 5 is a perspective view illustrating an assembled state of a body in FIG. 4.
Figure 6:
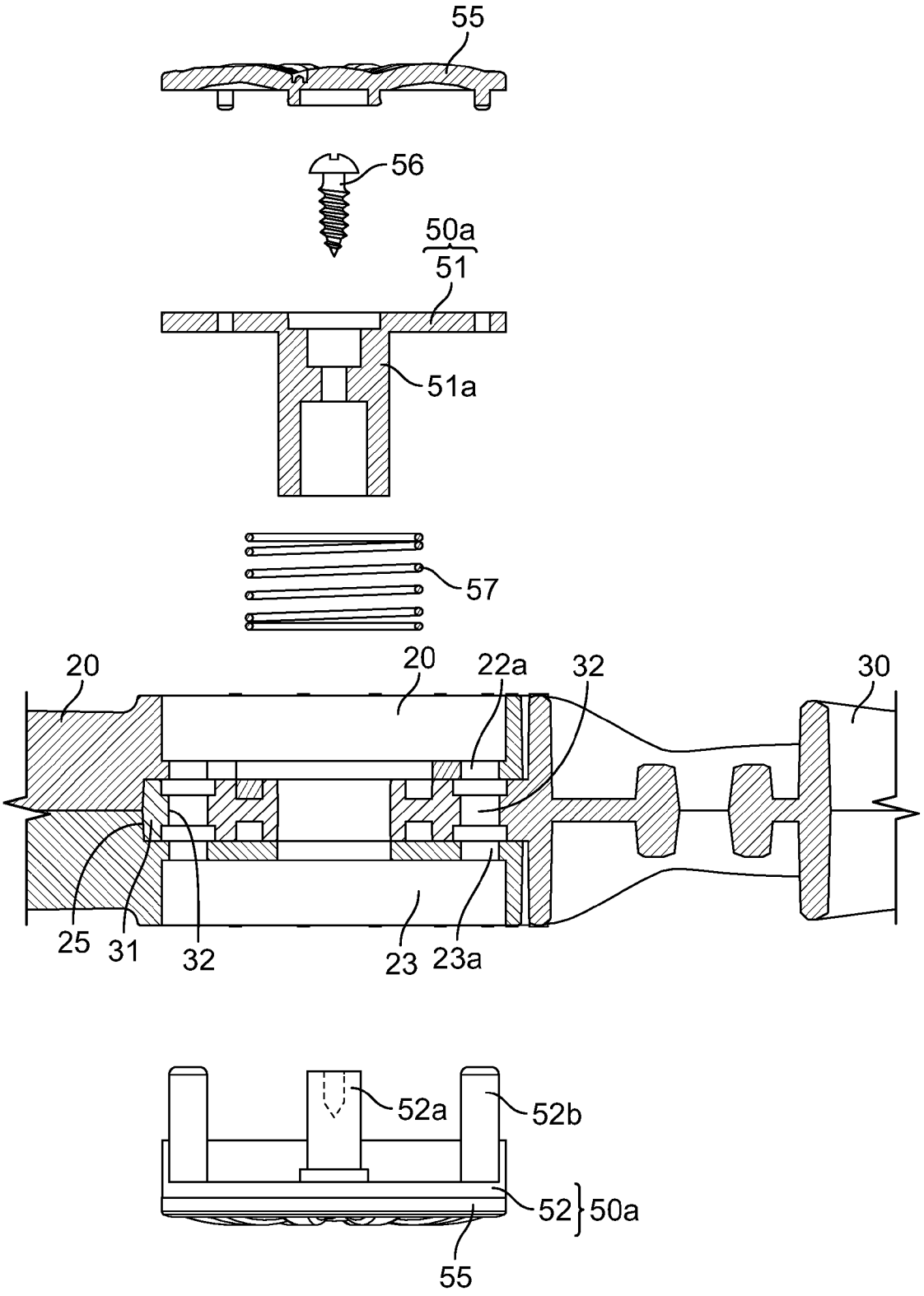
FIG. 6 is an exploded cross-sectional view illustrating the angle adjustor for the toy crossbow according to the present invention.

A preferred embodiment of the present invention will now be described in detail with reference to the accompanying drawings.

A toy bow according to the present invention includes a limb 10 and angle adjustors 50, and a tow crossbow according to the present invention includes the toy bow consisting of the limb 10, the angle adjustor 50, and a stock 60.

Specifically, if the limb 10 is detached from the stock 60, the limb 10 can be used as a bow. On the contrary, if the limb 10 is mounted to the stock 60, it can be used as the crossbow 1.

Therefore, since only the difference between the bow and the crossbow 1 is the stock 60, the crossbow 1 including all components will be described hereinafter by way of example.

The limb 10 is designed to be bent in one direction, like a bow, and may be bent and formed in various shapes from a simple one to a complicated one, as illustrated in the drawings.

Both ends of the limb 10 has ribs 36 for attaching the bowstring 40 to the ends thereof.

Specifically, one end of the bowstring 40 has a loop which is hooked and locked to the rib 36 provided on one end of the limb 10, and the other end of the bowstring 40 also has a loop which is hooked and locked to the rib 36 provided on the other one end of the limb 10.

When the bowstring 40 is attached to the ribs 36 provided on both ends of the limb 10, the bowstring is held to be tight, and the tight degree can be adjusted when the bowstring 40 is fixed.

The limb 10 has a body 20 mounted to the stock 60, and a pair of wings 30 which are engaged to both ends of the body 20 to be able to adjust an angle thereof by the angle adjustor 50, to which the bowstring 40 is attached.

The body 20 is provided with a stock mounting portion 24 protruding from a center, and one end of the stock 60 is formed with an engaging groove 64 to which the stock mounting portion 24 is detachably engaged.

The body 20 is formed with an arrow passing hole 21 through which an arrow 45 passes. The arrow passing hole 21 is formed concentrically with the stock mounting portion 24. That is, the arrow passing hole 21 is formed to penetrate the stock mounting portion 24, as well as the body 20.

The engaging groove 64 formed on the stock 60 communicates with the arrow passing hole 63. That is, the engaging groove 64 is formed concentrically with the arrow passing hole 63.

The stock mounting portion 24 of the body 20 is provided with a protrusion (not illustrated) on an outer peripheral surface thereof, and an inner peripheral surface of the engaging groove 64 formed on the stock 60 is formed with a groove (not illustrated). If the stock mounting portion 24 of the body 20 is fitted into the engaging groove 64 of the stock 60, the protrusion is locked to the groove, thereby increasing an engaging force between the body 20 and the stock and thus preventing disengaging thereof. Of course, the stock 60 can be easily disengaged from the body by hands.

Since the stock is easily disengaged from the body 20 of the stock 10, if the stock 60 is separated, the crossbow 1 can be converted into the bow, thereby improving the use application.

If the arrow 45 is placed in the arrow passing hole 21 of the body 20, the arrow 45 passes the body 20, and then is seated on an upper surface of the stock 60.

Each angle adjustor 50 has a disc 31 which is formed on an end of each wing 30 and is provided with a plurality of angle set holes 32 in a circumferential direction; disc engaging grooves 25 which are formed on both ends of the body 20 so that the disc 31 is rotatably engaged to both ends of the body 20, and circular grooves 22 and 23 which are formed on both sides of the body 20 in an axial direction of the disc 31; pin guides holes 22*a* and 23*a* which penetrate bottom surfaces of the circular grooves 22 and 23 at positions corresponding to the angle set holes 32; and an angle adjusting portion 50*a* for adjusting the angle of the wings 30, the angle adjusting portion 50*a* having pins 52*b* which are installed to the circular grooves 22 and 23 of the body 20, and are selectively locked to the angle set holes 32 through the pin guide holes 22*a* and 23*a*.

In this instance, the disc 31 of the wing 30 is superimposed with the disc engaging grooves 25 formed on both ends of the body, and the disc 31 is concentrically positioned in the disc engaging grooves 25.

The plurality of angle set holes 32 are spaced apart from each other at regular intervals in the circumferential direction, and the angle of the wings 30 can be accurately adjusted in comparison with the spaced angle of the angle set holes 32.

The body 20 may be formed in unit, but is preferably formed to have to bodies so as to be easily manufactured by a mold. In this instance, the body 20 is divided into two parts on the basis of the disc engaging groove 25.

The circular grooves 22 and 23 are formed on both sides of the body 20 in the axial direction of the disc 31 to have a desired depth. A bottom surface is formed between both circular grooves 22 and 23 of the body 20 and the disc engaging grooves 25 so as to divide the grooves.

The pins 52*b* of a second adjusting disc 52 which are described later are inserted into the pin guide holes 22*a* and 23*a* penetrating the bottom surfaces of the circular grooves, and the pine guide holes are formed in plural. In the drawings, four pin guide holes 22*a* and 23*a* are formed on the bottom surfaces of the circular grooves 22 and 23, respectively.

The four pin guide holes 22*a* and 23*a* are formed at an interval of 90 degrees. In this instance, the four pin guide holes 22*a* and 23*a* correspond to four holes among the plurality of angle set holes 32 formed in the disc 31.

The angle adjusting portion 50*a* has a first adjusting disc 51 with a first support shaft 51*a* which is inserted into the circular groove 22 of the body 20 and penetrates the bottom surface of the circular grooves 22 and 23 and a center of the disc 31, and a second adjusting disc 52 with a second support shaft 52*a* which is inserted into the circular groove 23 of the body 20 and is engaged with the first support shaft 51*a*, and the second adjusting disc 52 has the pins 52*b*.

Four pins 52*b* are provided to correspond to the position of the four pin guide holes 22*a* and 23*a*.

The first adjusting disc 51 and the second adjusting disc 52 are engaged to each other by a screw 56 in the state in which the second support shaft 52*a* of the second adjusting disc 52 is inserted into the first support shaft 51*a* of the first adjusting disc 51.

In the state in which the first adjusting disc 51 is inserted in the circular groove 22 of the body 20, and the second adjusting disc 52 is inserted in the circular groove 23 of the body 20, the first and second support shafts 51 and 52*a* are moved together by engagement of the screw 56.

That is, if the first adjusting disc 51 is pushed, the second adjusting disc 52 is moved in the same direction.

If the first and second adjusting discs 51 and 52 are assembled to the circular grooves 22 and 23 of the body 20 in the state in which the disc 31 of the wing 30 is inserted into the disc engaging groove 25 of the body 20, the pins 52*b* of the second adjusting disc 52 penetrate the pin guide holes 23*a*, and then are inserted into the angle set holes 32 of the disc 31 (initial position).

The first adjusting disc 51 and the second adjusting disc 52 are reciprocated in the axial direction of the first and second support shafts 51*a* and 52*a*.

Specifically, in the case of adjusting the angle of the wing 30, if the first adjusting disc 51 is pushed in one direction at the initial position, the second adjusting disc 52 is moved at the same time. In this instance, the pins 52*b* come out from the angle set holes 32 of the disc 31, and then extend to only the pin guide holes 23*a*. Therefore, it is possible to freely adjust the angle of the wing 30.

In the case of fixing the angle of the wing 30 at the current position, the first and second adjusting discs 51 and 52 are operated to the initial position. Specifically, if the first pushed adjusting disc 51 is released, the first adjusting disc 51 and the second adjusting disc 52 are returned to the initial position by a resilient member 57 which will be described later. In this instance, the pins 52*b* of the second adjusting disc 52 are again inserted into the angle set holes 32 of the disc 31, and extend to the pin guide holes 22*a* and 23*a* and the angle set holes 32, thereby setting the angle of the wing 30.

If the angle of the wing 30 is slightly turned in the state in which the first adjusting disc 51 is pushed, the pins 52 of the second adjusting disc 52 are locked to the disc 31, and the first and second adjusting discs 51 and 52 are maintained in the pushing state. In this instance, if the angle set holes 32 of the disc 31 coincide with each other by additionally turning the angle of the wing 30, the pins 52*b* are inserted into the angle set holes 32 by the resilient member 57, such that the first and second adjusting discs 51 and 52 are automatically returned to the initial position.

The resilient member 57 is installed to the inside of the circular groove 22 to allow the first and second adjusting discs 51 and 52 to automatically return to the initial position when the first and second adjusting discs 51 and 52 are operated in one direction.

The resilient member 57 is made of a coil spring, and is interposed between the first adjusting disc 51 and the disc 31 to apply a resilient force to the first adjusting disc 51 and thus return the first adjusting disc to the initial position.

The outer peripheral surface of the disc 31 is formed with a plurality of locking grooves 33 at regular intervals, and a leaf spring 35 which is resiliently locked to the locking groove 33 is installed in an inner peripheral surface of the disc engaging groove 25, thereby giving a sense of locking for every angle adjusting position of the wing 30.

The stock 60 has a nut 62 for holding the bowstring 40 in a drawn state, and a trigger 61 for operating the nut 62.

The nut 62 is formed integrally with the trigger 61, and is spaced apart from the trigger at a desired angle. Specifically, the trigger 61 protrudes from a lower portion of the stock 60, and the nut 62 protrudes from an upper portion of the stock 60.

Accordingly, when the trigger 61 is pulled in the state in which the bowstring 40 is held by the nut 62, the nut 62 is rotated and moved down in a downward direction, so that the drawn bowstring 40 is released and then is fired.

Each wheel 55 is placed in both circular grooves 22 and 23 of the body 20 to cover the outside of the first and second adjusting discs 51 and 52. The wheels 55 are engaged to the first and second adjusting discs 51 and 52 to improve its design.

Hereinafter, the operation of the toy bow and the crossbow using the same according to the present invention will be described.

First, the limb 10 is mounted to the stock 60 to form the crossbow 1. Specifically, the stock mounting portion 24 of the body 20 is easily fitted to the engaging groove 64 of the stock 60.

Of course, if the stock 60 is separated from the limb 10, the limb can be used as the bow.

The operation of the crossbow 1 will now be described by way of example.

In the case of the crossbow 1, after the bowstring 40 is drawn and then is held by the nut 62 of the stock 60, the arrow 45 is mounted.

The arrow 45 is pushed to the position of the nut 62 through the arrow passing hole 24 of the stock 10.

And then, in the case of firing the arrow 45, if the trigger 61 of the stock 60 is pulled, the nut 62 is moved down to release the bowstring 40, thereby firing the arrow 45.

The method of adjusting the angle of the wings 30 of the limb 10 will now be described. The method of adjusting the angle of the wings 30 in the bow is identical to that of the crossbow 1.

First, in the case of adjusting the angle of the wings 30, if the first adjusting disc 51 is pushed in one direction, the second adjusting disc 52 is simultaneously moved in the same direction. In this instance, the pins 52*b* come out from the angle set holes 32 of the disc 31, and then extend to only the pin guide holes 23*a*. Therefore, it is possible to freely adjust the angle of the wing 30.

In the case of fixing the angle of the wing 30 at the current position, the first and second adjusting discs 51 and 52 are operated to the initial position. Specifically, if the first pushed adjusting disc 51 is released, the first adjusting disc 51 and the second adjusting disc 52 are returned to the initial position by the resilient member 57. In this instance, the pins 52*b* of the second adjusting disc 52 are again inserted into the angle set holes 32 of the disc 31, and extend to the pin guide holes 22*a* and 23*a* and the angle set holes 32, thereby setting the angle of the wing 30.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A toy bow comprising a limb and a bowstring attached to two distal ends of the limb; the limb is configured to bend in one direction, and the limb is formed of a body, a pair of wings and a pair of angle adjusters to rotatably connect two distal ends of the body to a proximal end of a corresponding wing, each angle adjuster is configured to adjust an angle of the corresponding wing with respect to the body; and the bowstring is attached to two distal ends of the pair of wings;

wherein said each angle adjuster comprises:

a disc formed on a proximal end of the corresponding wing and comprises a plurality of angle set holes in a circumferential direction;

first and second circular grooves formed respectively on two sides of the body at the corresponding distal end of the body in an axial direction of the disc;

a disc engaging groove formed on a corresponding distal end of the body between the first and second circular grooves to rotably engage the disc;

pin guide holes penetrating bottom surfaces of the circular grooves at positions corresponding to the angle set holes; and an angle adjusting portion configured to adjust the angle of the corresponding wing with respect to the body, the angle adjusting portion comprises:

a first adjusting disc comprising a first support shaft, the first support is insertable into the first circular groove to penetrate a bottom surface of the first circular groove and a center of the disc;

a second adjusting disc comprising a second support shaft, the second support shaft is insertable into a second circular groove to engage with the first support shaft, the second adjusting disc of the angle adjusting portion comprises pins that are selectively locked to the angle set holes through the pin guide holes;

the first adjusting disc and the second adjusting disc are reciprocated in an axial direction of the first and second support shafts; and the pins extend only to the pin guide holes in response to an adjustment of the angle of the corresponding wing and the pins extend to the pin guide holes and the angle set holes in response to a fixation of the angle of the corresponding wing.

2. The toy bow according to claim 1, further comprising a resilient member installed inside of the first circular groove to automatically return the first and second adjusting discs to their initial positions in response to an operation of the first and second adjusting discs in one direction.

3. The toy bow according to claim 1, further comprising a plurality of locking grooves formed an outer peripheral surface of the disc at predetermined intervals; and a leaf spring resiliently locked to the locking groove and installed in an inner peripheral surface of the disc engaging groove opposite to the outer peripheral surface of the disc to provide locking for each angle adjusting position of the corresponding wing.

4. The toy bow according to claim 1, wherein a number of the pin guide holes being less than a number of the angle set holes and the number of the pin guide holes is equal to a number of the pins.

5. The toy bow according to claim 1, wherein the pin guide holes are formed at an interval of 90 degrees on the first and second circular grooves.

6. A toy crossbow comprising a limb, a bowstring attached to two distal ends of the limb, and a stock engaged to the limb; the limb is configured to bend in one direction, and the limb is formed of a body configured to engage the stock, a pair of wings and a pair of angle adjusters to rotatably connect two distal ends of the body to a proximal end of a corresponding wing, each angle adjuster is configured to adjust an angle of a corresponding wing with respect to the body; and the bowstring is attached to two distal ends of the pair of wings;

wherein said each angle adjuster comprises:

a disc formed on a proximal end of the corresponding wing and comprises a plurality of angle set holes in a circumferential direction;

first and second circular grooves formed respectively on two sides of the body at the corresponding distal end of the body in an axial direction of the disc;

a disc engaging groove formed on a corresponding distal end of the body between the first and second circular grooves to rotably engage the disc;

pin guide holes penetrating bottom surfaces of the circular grooves at positions corresponding to the angle set holes; and an angle adjusting portion configured to adjust the angle of the corresponding wing with respect to the body, the angle adjusting portion comprises:

a first adjusting disc comprising a first support shaft, the first support is insertable into the first circular groove to penetrate a bottom surface of the first circular groove and a center of the disc;

a second adjusting disc comprising a second support shaft, the second support shaft is insertable into a second circular groove to engage with the first support shaft, the second adjusting disc of the angle adjusting portion comprises pins that are selectively locked to the angle set holes through the pin guide holes;

the first adjusting disc and the second adjusting disc are reciprocated in an axial direction of the first and second support shafts; and the pins extend only to the pin guide holes in response to an adjustment of the angle of the corresponding wing and the pins extend to the pin guide holes and the angle set holes in response to a fixation of the angle of the corresponding wing.

7. The toy crossbow according to claim 6, further comprising a stock mounting portion protruding from the body; and an engaging groove formed at one end of the stock to detachably engage the stock mounting portion.

8. The toy bow according to claim 2, further comprising a resilient member installed inside of the first circular groove to automatically return the first and second adjusting discs to their initial positions in response to an operation of the first and second adjusting discs in one direction.

9. The toy bow according to claim 2, further comprising a plurality of locking grooves formed an outer peripheral surface of the disc at predetermined intervals; and a leaf spring resiliently locked to the locking groove and installed in an inner peripheral surface of the disc engaging groove opposite to the outer peripheral surface of the disc to provide locking for each angle adjusting position of the corresponding wing.

10. The toy bow according to claim 6, wherein a number of the pin guide holes being less than a number of the angle set holes and the number of the pin guide holes is equal to a number of the pins.

11. The toy bow according to claim 6, wherein the pin guide holes are formed at an interval of 90 degrees on the first and second circular grooves.

* * * * *